United States Patent [19]

Hoffmann et al.

[11] Patent Number: 4,682,011

[45] Date of Patent: Jul. 21, 1987

[54] FURNACE FOR THE PARTIAL HEAT TREATMENT OF WORK TOOLS

[75] Inventors: Gerhard Hoffmann, Kahl; Rudolf Bauer, Eschborn; Paul Heilmann, Maintal; Erwin Schumann, Bruchköbel, all of Fed. Rep. of Germany

[73] Assignee: Degussa Aktiengesellschaft, Frankfurt, Fed. Rep. of Germany

[21] Appl. No.: 795,292

[22] Filed: Nov. 5, 1985

Related U.S. Application Data

[63] Continuation of Ser. No. 599,306, Apr. 12, 1984, abandoned.

[30] Foreign Application Priority Data

Apr. 15, 1983 [DE] Fed. Rep. of Germany ..... 3313651

[51] Int. Cl.[4] ..... H05B 3/62

[52] U.S. Cl. ..... 219/390; 219/521

[58] Field of Search ..... 219/390, 354, 521, 394, 219/395, 400; 148/13, 149, 145, 20.3

[56] References Cited

U.S. PATENT DOCUMENTS

| | | | |
|---|---|---|---|
| 1,925,116 | 9/1933 | Spence | 148/149 |
| 2,305,056 | 12/1942 | Austin | 219/395 |
| 3,168,607 | 2/1965 | Greene | 148/20.3 |
| 3,395,241 | 7/1968 | Roman | 219/390 |
| 3,615,927 | 10/1971 | Paulson | 148/149 |

FOREIGN PATENT DOCUMENTS

| | | | |
|---|---|---|---|
| 3111218 | 12/1982 | Fed. Rep. of Germany | 219/400 |
| 581926 | 12/1924 | France | 219/390 |
| 1362560 | 4/1964 | France | 219/354 |

*Primary Examiner*—Clifford C. Shaw
*Assistant Examiner*—Teresa J. Walberg
*Attorney, Agent, or Firm*—Beveridge, DeGrandi & Weilacher

[57] ABSTRACT

For the partial heat treatment of tools which have a work surface and a clamping in region, there is disclosed a furnace, the useful space of which is subdivided into two separate heating spaces by a plate made of heat insulating material whereby the temperature in these heating spaces is lowered by disconnection of the connecting members between the individual heating elements of the all-around heating and the clamping in region of the work tools may be maintained below the conversion temperature of the metal.

10 Claims, 1 Drawing Figure

FURNACE FOR THE PARTIAL HEAT TREATMENT OF WORK TOOLS

REFERENCE TO RELATED APPLICATION

Figure 1:
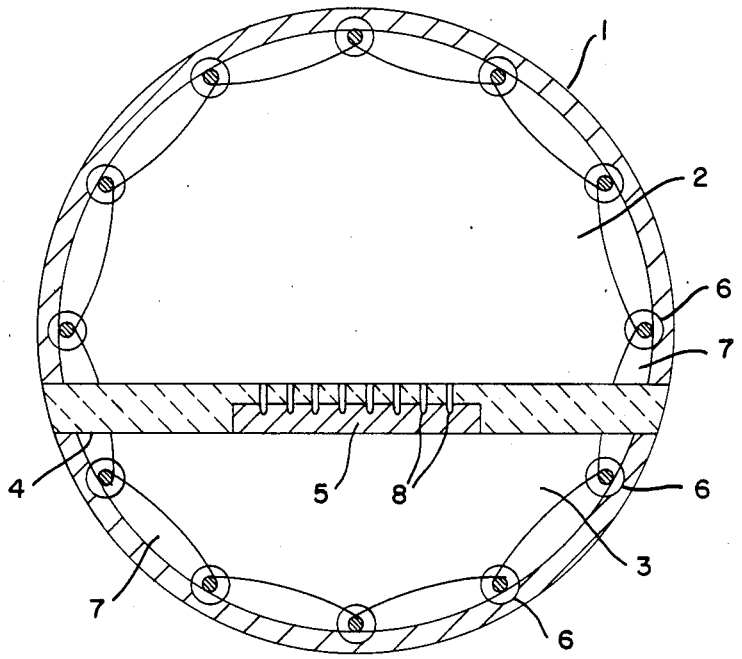

This application is a continuation of our copending application Ser. No. 599,306 filed Apr. 12, 1984, now abandoned.

The invention relates to a furnace, especially a vacuum one-chamber furnace with compressed gas quenching for the partial heat treatment of work tools having a work surface region and a clamping or attachment region, which work tools with their clamping region are attached in one or a plurality of supports in the inside of the furnace provided with an all-around heating capability in the form of individual heating elements which are interconnected by way of connecting members.

Drills, cutters, reamers and similar work tools have a clamping or attachment region by which they are attached in the cutting heads of machine tools and an operating or work surface region with which the machining operations are carried out. Because of the varying requirements made of these regions of the work tools, they also must possess variable characteristics such as, for example, characteristics of strength. It is possible therefore to fabricate these work tools from two different materials or to subject the two different areas of the work tool to a variable heat treatment. However, in the case of uniform material, it is necessary to use partial heat treatments which function to harden only the area of the actual working surface and thus impart a greater serviceability to that region of the work tool, while the clamping or insert region which attaches to the machining device almost retains the original technical characteristics.

It is known in the art from German OS 31 11 218 to provide a furnace for the partial heat treatment of work tools which have a work surface region and a clamping or attachment region. For this purpose, the clamping region of the work tools is attached in a support which is insulated and/or cooled during the heat treatment of the work tool so that only the working surface is heated beyond the material-specific conversion temperature and subsequently quenched, while the clamping in region remains on an essentially equal temperature level during the heating and quenching treatment. For this purpose, the work tools have their clamping in region inserted in bores of a plate-shaped support which is insulated and cooled against the furnace heat. This furnace has the disadvantage that considerable temperature differences arise perforce between work surface regions and clamping in regions which may give cause to variable clamping conditions in the material and to change of dimension and shape.

Therefore, it was the object of the present invention to provide a furnace, especially a vacuum one-chamber furnace with gas quenching, for the partial heat treatment of work tools having a work surface region and a clamping in or attachment region, which work tools are attached with their clamping in region in one or more holding or retaining supports inside the furnace, with an all-around heating in the form of individual heating elements which are interconnected by way of connecting members, whereby during the heat treatment between clamping in region and work surface region of the work tools, as small as possible a difference in temperature arises and without heating the clamping in region beyond the material-specific conversion temperature.

The object was achieved according to the invention through the fact that the holding or retaining supports are attached and integrated in a plate made of heat insulating material which subdivides the useful space of the furnace into two separate heating spaces and in that the connecting members between the heating elements are capable of being disconnected so as to enable disconnection of the heating elements from the electrical circuit according to the desired temperature control.

Preferably, the heat insulating material of the plate dividing the useful space of the furnace consists of ceramic, graphite- and/or ceramic felt. Any suitable insulating material of sufficient strength may be used for this purpose. Advantageously, the connecting members between the individual heating elements are formed as movable links, or elements that can be disconnected from the electrical heating circuit, so that the temperature may be raised or lowered at will and in a simple manner, depending on the number of electrically coupled heating elements in the lower heating space.

The invention will be further understood with reference to the drawing which illustrates a schematic cross section of a furnace construction.

With the furnace according to the invention, it is possible to regulate the heat treatment temperature in the clamping in region of the work tools depending upon the nature and composition of the material of construction of the work tool as well as the shape and the size thereof, between ambient temperature and conversion temperature so that the material specific conversion point during the entire heating-, austenitization- and quenching treatment is not exceeded, while the working surface region of the work tools is hardened in the heat treatment and quenching treatment. At the same time, the temperature difference between the two regions of the work tool will be selected in such a way that only minimal heat stresses may occur.

In carrying out the invention, the work tools essentially in a vertical upright position are arranged on a support by inserting their clamping in region into blind holes located on the support. As the support, one uses preferably a metal or ceramic plate, the surface of which is provided with a thermally insulating layer. The material of the support is generally selected so that it will differ from the surrounding plate.

Described in further detail, the invention is illustrated in the drawing which shows schematically an embodiment by way of example of the furnace according to the invention in cross section. The useful space of the furnace (1) is subdivided into two separate heating spaces (2, 3) by a plate (4). The furnace is equipped with an all-around heating arrangement consisting of individual heating bars (6). Into the plate (4) made of heat insulating material and which spans the interior dimension of the furnace, the support (5) is attached and integrated into which blind holes (8) have been drilled which also penetrate the insulating layer on the support (5) included in the plate (4). If the plate (4) is chosen to be a ceramic such as ceramic fibrous material, the support (5) is chosen as a steel or other suitable metal material. If support (5) is selected as a ceramic, then plate (4) is made of ceramic felt. This is done to maintain a difference in material between plate (4) and support (5). The coating on support (5) is a thermally insulating layer for which any suitable insulating material may be used.

Support (5) is glued or adhered to the plate (4) by any suitable adhesive. The individual heating elements (6) are electrically interconnected by way of connecting members (7). In carrying out the heat treatment of the work tools, one of the two heating spaces, normally the heating space (2) above the heat insulating plate (4), is heated with full heating capacity in which the work surface region of the tools is located, while the other space (3) is adjusted to a lower temperature below the conversion temperature of the heat treated raw material, by disconnecting one or several connecting members (7) between the heating elements (6) in this heating space (3). The connection of the heating elements can be by any suitable electrical means, including means for selectively connecting and disconnecting the heating elements from the electrical circuit.

In this way, it is possible to selectively heat treat the work tool by subjecting the working surface to the higher heat treatment temperatures and by exposing the holding portion or clamping region of the work tool to a lesser temperature.

The plate (5) generally divides the furnace volume into two portions, one of which can be somewhat larger than the other in order to possess the needed higher heat capacity. This is a matter of adjustment depending upon experiences.

We claim:

1. A furnace for the controlled partial heat treatment of work tools comprising a vacuum one-chamber furnace provided with compressed gas quenching for the partial heat treatment of work tools, each of said tools having a working region and a clamping region, support means (5), located inside said chamber, adapted for releasably positioning the clamping region of at least one work tool, said furnace having an interior space and provided with all-around heating in the form of heating means located inside said furnace interior space, said support means (5) being integrated in a plate (4) made of heat insulating material, which plate subdivides said furnace interior space into two separate heating section chambers (2, 3), each of said separate heating section chambers (2, 3) provided by separately controllable heating means, there being no cooling means for cooling of work tools during the heat treatment and without heating the clamping region of said work tools beyond their material specific conversion temperature.

2. The furnace as set forth in claim 1, wherein plate (4) is composed of a member of the group consisting of ceramic, graphite, and ceramic felt.

3. The furnace as set forth in claim 1, wherein said plate (4) spans the interior of the furnace.

4. The furnace as set forth in claim 3, wherein support (5) is adhered to plate (4) by an adhesive.

5. The furnace as set forth in claim 1, wherein said heating means in chamber (2) is separately controlled with respect to heating means in chamber (3).

6. The furnace as set forth in claim 1, wherein at least one work tool is positioned with its clamping region in a hole located in said support and the working region is located in the upper of the two chambers.

7. The furnace as set forth in claim 1, wherein the furnace is of circular cross-section (1).

8. The furnace as set forth in claim 1, wherein the plate is adapted to position said work piece so that the working region thereof extends into said upper chamber for said heat treatment.

9. The furnace as set forth in claim 1, wherein said plate permits the temperature in each chamber to be different.

10. A method for the partial heat treatment of work tools comprising providing a vacuum one-chamber furnace with means for gas quenching, positioning at least one work tool having a clamping region and a working region in the furnace, positioning the clamping region of said work tool in holding means located in a support on a plate spanning said furnace, subjecting said working region of said tool to a temperature in an upper heating zone sufficient for the heat treatment thereof, while maintaining the holding means in a lower heating zone at a temperature below the heat treatment temperature of the work tool, there being no cooling means utilized in said heat treatment.

* * * * *